United States Patent [19]

Duvivier

[11] Patent Number: 4,662,011

[45] Date of Patent: May 5, 1987

[54] SPRING MATTRESS

[75] Inventor: Jean-Marie Duvivier, Usson du Poitou, France

[73] Assignee: Duvivier-Durev, Jousse, France

[21] Appl. No.: 754,971

[22] Filed: Jul. 18, 1985

[30] Foreign Application Priority Data

Jul. 23, 1984 [FR] France ..... 84 11659

[51] Int. Cl.[4] ..... A47C 27/04

[52] U.S. Cl. ..... 5/476; 5/246

[58] Field of Search ..... 5/255, 476, 239, 267, 5/246, 248, 256, 258; 267/87, 88, 91, 95

[56] References Cited

U.S. PATENT DOCUMENTS 2,550,294 4/1951 Platis ..... 5/246
3,099,843 8/1963 Simon .
3,354,477 11/1967 Bartz .
4,488,712 12/1984 Higgins ..... 267/91

FOREIGN PATENT DOCUMENTS 2758702 7/1979 Fed. Rep. of Germany .

*Primary Examiner*—William F. Pate, III
*Assistant Examiner*—Creighton Smith
*Attorney, Agent, or Firm*—Dennison, Meserole, Pollack & Scheiner

[57] ABSTRACT

The invention relates to a spring mattress of which the body is formed by spaced apart rows of springs connected by elastically deformable members. The latter enable the body to bend along transverse lines of break located between the rows of springs, with the result that the mattress is so flexible as to be adapted for use on an articulated bedstead or slatted framework.

9 Claims, 6 Drawing Figures

Fig. 4
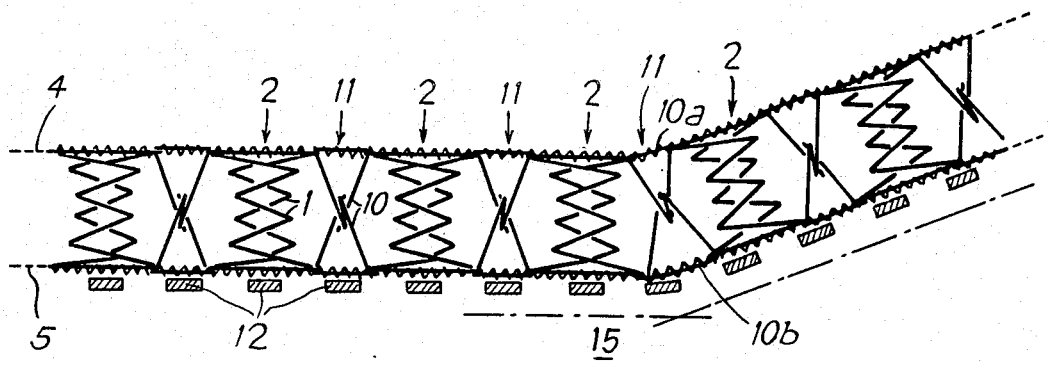
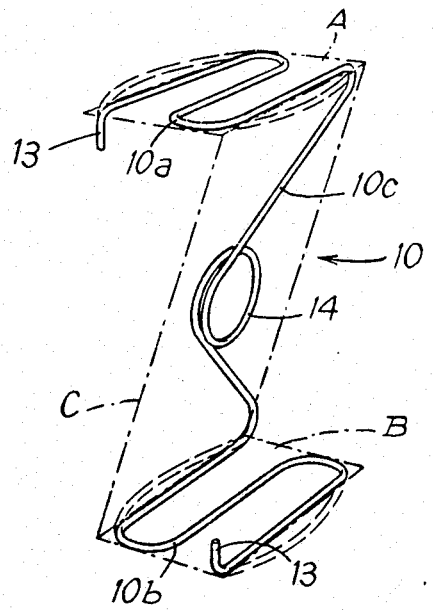
Fig. 3

SPRING MATTRESS

The present invention relates to a spring mattress comprising, in a supple envelope, an elastic body composed of an assembly of springs distributed in transverse assemblies forming successive rows, the springs of each assembly being inscribed in a prism with a substantially rectangular base and these prisms, juxtaposed in the longitudinal direction of the mattress, defining by their free, opposite, lateral faces, the two principal surfaces of the mattress, whilst two adjacent assemblies of springs are connected together exclusively at the level of the edges contiguous with the prisms which define them, located in said principal surfaces.

Spring mattresses of this type are well known and widely used. They present over foam or latex mattresses the advantages of being more hygienic thanks to the large volume of air that they contain, of not presenting risks of allergy for the users and of offering an excellent stability of shape in time. However, they are relatively rigid and not suitable for use on articulated bedsteads, which must receive foam or latex mattresses, the latter having the flexibility necessary for following the angular configuration that such bedsteads may take. The term "bedstead" is understood in this specification to mean supports of all forms for mattresses, including slatted frameworks.

It is an object of the present invention to overcome this drawback in order to allow spring mattresses to be used on articulated bedsteads.

To this end, according to the invention, at least two adjacent assemblies among the assemblies of springs composing the body of the mattress are disposed with a certain mutual spaced apart relationship and are connected, through the space thus created, by elastically deformable elements, capable of taking up efforts both of extension and of compression, which enable the edges opposite the prisms defining these assemblies mutually to move closer to or away from one another, and thus allow a break of the principal surfaces of the mattress by flexion at the level of said space.

In this way, these two assemblies of springs are not in mutual contact and directly connected to each other as is conventional, but are connected via elastically deformable elements which create between these two assemblies a flexible zone performing the role of a hinge and thus enabling the body, and therefore the mattress, to fold along a corresponding transverse line of break. This hinge zone being disposed opposite an articulation of the articulated bedstead intended to receive the mattress, the latter may bend and take an angular configuration similar to that given to the bedstead.

Considering that the or each articulation of an articulated bedstead may be located at various positions over its length, it is preferable if all the assemblies of springs are spaced apart mutually and connected in the spaces thus created by elastically deformable elements, as has been set forth hereinabove for at least two adjacent assemblies. The body thus presents a large number of transverse lines of break located between the successive assemblies of springs.

In an advantageous embodiment, the above-mentioned connecting elements comprise first elastically deformable elements disposed between the homologous edges of the assemblies of springs respectively located in the same principal surface of the mattress and, to ensure horizontal stability of the mattress, second elastically deformable elements disposed obliquely in the thickness of the body between the edges not contiguous with said adjacent assemblies located respectively in one and the other of said principal surfaces.

Only the connections in a determined principal surface may be ensured by first elastically deformable elements, the connections in the other principal surface being effected thanks to non-deformable elements of articulation. However, it is preferable, in order to increase the possibilities of angular flexion of the mattress, if the homologous edges contiguous with the adjacent assemblies of springs located both in one and in the other of the principal surfaces, be connected by first elastically deformable elements. On the other hand, to improve the stability of the mattress with respect to shear efforts in its longitudinal direction, the edges for attachment of the second elements located in the same principal surface should be provided to belong, along the corresponding space, alternately to one and to the other of the two assemblies connected by these elements, which are thus disposed obliquely in one direction and in the other, alternately.

The connecting elements may be constituted by elastic rods made in the form of a flat zig-zag, namely preferably in the form of a flattened S for the first elements and, likewise preferably, in the form of a Σ for the second elements. At least certain of the elastic rods constituting the connecting elements may in addition be wound on themselves in one or more loops in the region of at least one of the angles that they comprise.

In a particularly simple embodiment, the connecting elements are grouped as connecting members formed by an elastic rod in one piece which is fashioned to form two first elements in parallel planes and a second element interposed obliquely therebetween, the planes of these three elements thus connected being arranged so that their section through a perpendicular plane presents the form of a Z.

The invention will be more readily understood on reading the following description with reference to the accompanying drawings, in which:

FIG. 3 shows, in perspective and on a larger scale, one of the connecting members that the body of FIGS. 1 and 2 comprises.

Figure 1:
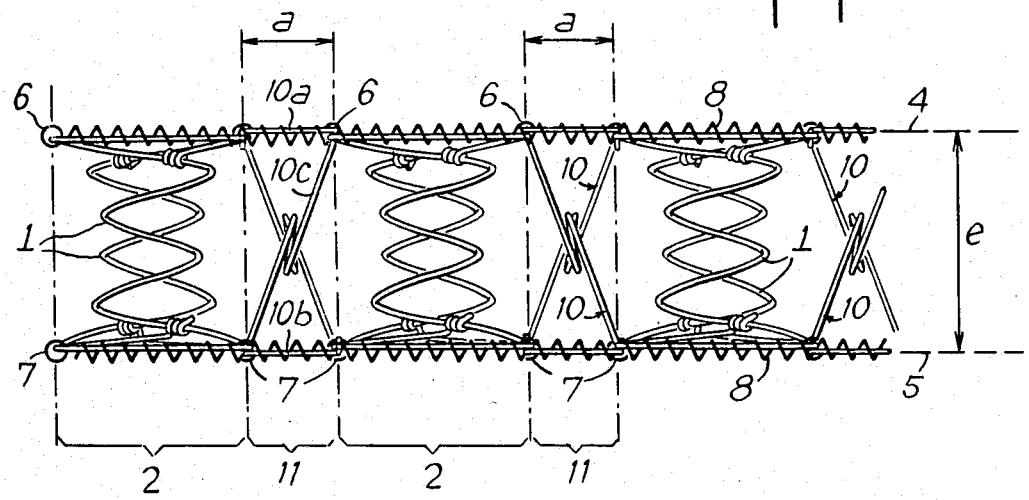
FIGS. 1 and 2 show, respectively in side elevation and in plan view, a portion of the body of a spring mattress according to the invention.
Figure 2:
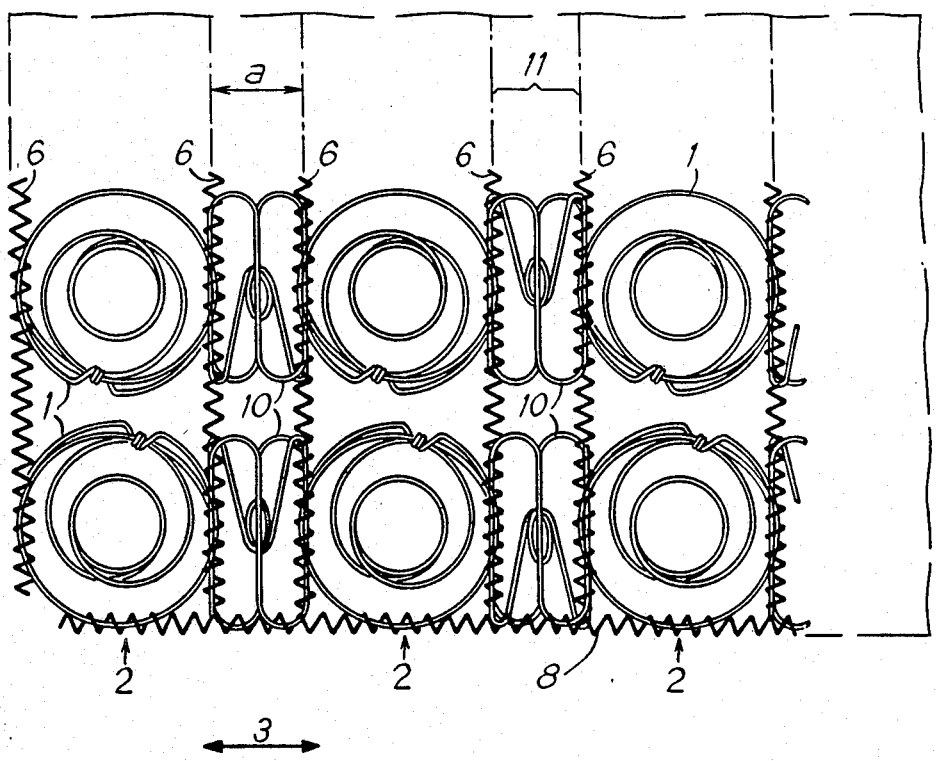
Figure 5:
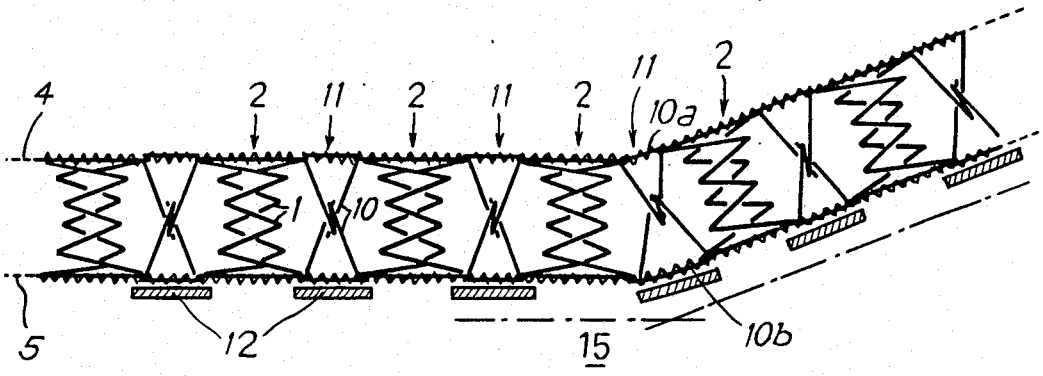
Figure 6:
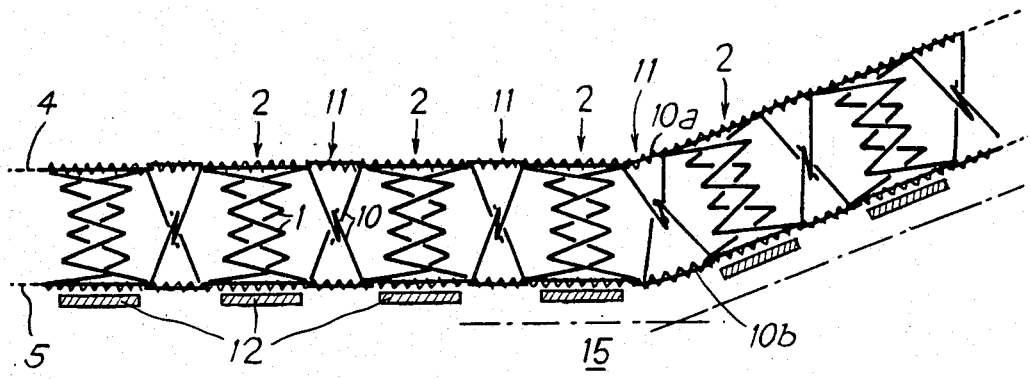

FIGS. 4 to 6 schematically show, in side elevation, a partial view of a mattress body according to FIGS. 1 and 2 bent on an articulated slatted framework, each of these Figures showing a particular distribution of the slats with respect to the springs of the mattress.

Referring now to the drawings, FIGS. 1 and 2 show a spring mattress according to the invention which comprises an elastic frame or body formed by an assembly of springs 1, covered by a supple textile envelope (not shown). The springs 1 are conventional biconical springs, constituted by a winding of elastic metal wire terminating in two flat, circular turns forming the heads or tops of the spring. The springs 1 are distributed in linear assemblies 2 forming transverse rows which succeed one another in the longitudinal direction 3 of the mattress, their heads being respectively contained in two parallel planes 4, 5 which define the principal surfaces of the mattress. The assemblies 2 of springs 1 are inscribed in transverse prismatic volumes, of rectangular section, of which the edges are materialized by long, helicoidally wound wires 6, 7, in the turns of which are held lateral parts of the heads of springs 1. Other helicoidal wires 8 extend along the longitudinal edges of the mattress and are engaged on parts of the heads of the end springs of the assemblies 2.

The successive assemblies 2 of springs 1 are not coupled, but spaced apart by spaces 11 equal in width, in which the elastic connecting members 10 which ensure assembly of said assemblies 2, are positioned. Each of these members 10 is constituted by an elastic wire, preferably metallic (of the "piano string" type), shaped to form (FIG. 3) three flat elastic elements, namely two first elements 10*a*, 10*b* in the form of a flattened S joined by a second element 10*c* in Σ form. The planes A, B of the first elements 10*a*, 10*b* are parallel and distant by an amount equal to the height of the springs 1, i.e. to the thickness e of the body of the mattress (FIG. 1). The plane C in which is contained the intermediate element 10*c* is not perpendicular to planes A, B of the end elements 10*a*, 10*b*, but extends obliquely with respect thereto, so that a section through a plane perpendicular to the three planes mentioned above has the form of a Z. The end arms of the Σ-shaped element 10*c* coincide with the intersections of plane C with planes A and B and merge with the respective end arms of the elements 10*a*, 10*b* by which the latter are joined to element 10*c*. S-shaped elements 10*a* and 10*b* are identical. Their length is equal to the value a of spaces 11 and comprise three parallel rectilinear arms joined by semi-circular incurved portions. In the region included between its two oblique arms, element 10*c* comprises a circular loop 14 increasing the flexibility of the element at that spot. Each elastic element 10*a*, 10*b*, 10*c* may work in its plane both in compression and in extension. In addition, elastic angular deformations may occur between each of the elements 10*a*, 10*b* and the intermediate element 10*c*.

The connecting members 10 are disposed in the spaces 11 separating the adjacent assemblies 2 of springs 1. Elements 10*a* and 10*b* of these members are taken by their end arms, terminating in locking tails 13, in the helicoidal fastening wires 6, 7 (FIG. 1), so that these elements are contained respectively in planes 4 and 5. Several connecting members are used for joining two adjacent assemblies 2, which are distributed over the length of the corresponding space 11. These members 10 are oriented alternately in one direction and in the other, so that the planes C of their intermediate elements 10*c* present an obliqueness of alternate direction, the section of these planes through a perpendicular plane having the form of an X, as may be seen in FIGS. 1 and 4. These elements, obliquely joining the heads of the springs 1 through the thickness e of the body, ensure, by an effect of crossed triangulation, the stability of said body despite the deformability of the connecting elements 10*a*, 10*b* lying in the principal planes 4, 5.

In FIG. 3, a variation in the connecting elements 10*a* and 10*b* is illustrated in broken lines. In this embodiment, the end arms of each of the elements are outwardly bowed to define convex edges facing opposed springs 1 between which the connecting member 10 is received and to which it is to be attached.

The spring mattress described is capable of leaving its natural flat conformation and of folding, along a transverse line of break (FIG. 4), level with a space 11 between two adjacent assemblies 2 of springs, so as to follow the shape of the different conformations that an articulated bedstead 15 (in the present case a slatted framework) may take. The connecting members 10 introduced between these assemblies of springs are in fact elastically deformable; along the line of break, the elements 10*a* lying in plane 4 are compressed and the opposite elements 10 lying in plane 5 extend. The slats 12 are distributed so that there is a slat beneath each of the rows of springs 1 and connecting members 10. In a variant embodiment, the slats 12 may be disposed solely beneath the rows of members 10 (FIG. 5) or solely beneath the rows of springs 1 (FIG. 6).

In the mattress shown by way of example, the connecting members 10 have substantially the same span, in transverse direction, as springs 1, and are distributed in this direction at the same pitch as the latter, each member 10 coinciding with a pair of opposite springs 1 which it connects together. However, this is not indispensable, and connecting members may be envisaged which are dimensioned and distributed differently with respect to the springs 1 of the successive assemblies 2.

Elements 10*c* of the body of a mattress according to the invention, interposed between the two principal surfaces, contribute to the degree of suppleness of the mattress, jointly with the springs 1. It is therefore possible, by playing on the characteristics of these elements which thus constitute auxiliary springs, to modify the properties of comfort of the mattress without touching the springs 1.

What is claimed is:

1. In a spring mattress comprising, in a supple envelope, an elastic body composed of springs distributed in transverse assemblies forming successive rows, the springs of each assembly being inscribed in a prism with a substantially rectangular base and these prisms, juxtaposed in the longitudinal direction of the mattress, defining by their free, opposite, lateral faces, the two principal surfaces of the mattress, two adjacent assemblies of springs having homologous edges at said principal surfaces defined by the lateral faces of the prisms and being connected together exclusively at the level of the homologous edges in said principal surfaces, the two adjacent assemblies of springs are disposed with a certain mutual spaced apart relationship and are connected, through the space thus created, by elastically deformable connecting elements, capable of taking up efforts both of extension and of compression, which enable the opposite edges of the prisms of the spaced adjacent assemblies mutually to move closer to or away from one another, and thus allow a break of the principal surfaces of the mattress by flexion at said space, the connecting elements comprising first elastically deformable planar elements disposed between the homologous edges of the spaced assemblies of springs and respectively lying in the same principal surfaces of the mattress substantially coplanar with these surfaces, and second elastically deformable elements disposed obliquely in the thickness of the body between the edges non-contiguous with said adjacent assemblies lying respectively in one and in the other of said principal surfaces.

2. The mattress of claim 1, wherein all the assemblies of springs are spaced apart mutually and connected in the created spaces by said elastically connecting elements.

3. The mattress of claim 1, wherein the connecting elements comprise first elastically deformable elements disposed between the homologous edges of the assemblies of springs respectively lying in the same principal surface of the mattress and second elastically deformable elements disposed obliquely in the thickness of the body between the edges non-contiguous with said adjacent assemblies lying respectively in one and in the other of said principal surfaces.

4. The mattress of claim 3, wherein the homologous edges contiguous with the adjacent assemblies of springs lying in one or in the other of the principal surfaces are connected by first elastically deformable elements.

5. The mattress of claim 3, wherein the fastening edges of the second elements lying in the same principal surface belong alternately, along the corresponding space, to one and to the other of the two assemblies joined by these elements.

6. The mattress of claim 1, wherein the connecting elements are constituted by elastic rods made in the form of a flat zig-zag.

7. The mattress of claim 6, wherein the first elements are constituted by elastic rods made in the form of a flattened S.

8. The mattress of claim 6, wherein at least certain of the elastic rods comprising the connecting elements are wound on themselves in at least one loop in the region of at least one angle defined by the zig-zag form.

9. In a spring mattress comprising, in a supple envelope, an elastic body composed of an assembly of springs distributed in transverse assemblies forming successive rows, the springs of each assembly being inscribed in a prism with a substantially rectangular base and these prisms, juxtaposed in the longitudinal direction of the mattress, defining by their free, opposite, lateral faces, the two principal surfaces of the mattress, two adjacent assemblies of springs having homologous edges at said principal surfaces and being connected together exclusively at the level of the edges contiguous with the prisms which define them, lying in said principal surfaces, the two adjacent assemblies of springs are disposed with a certain mutual spaced apart relationship and are connected, through the space thus created, by elastically deformable connecting elements, capable of taking up efforts both of extension and of compression, which enable the edges opposite the prisms defining these assemblies mutually to move closer to or away from one another, and thus allow a break of the principal surfaces of the mattress by flexion at the level of said space, the connecting elements comprising elastic rods in the form of a flat zig-zag and including first elastically deformable elements disposed between the homologous edges of the assemblies of springs respectively lying in the same principal surfaces of the mattress and second elastically deformable elements in the form of a Σ disposed obliquely in the thickness of the body between the edges non-contiguous with said adjacent assemblies lying respectively in one and in the other of said prinicipal surfaces.

10. In a spring mattress comprising, in a supple envelope, an elastic body composed of an assembly of springs distributed in transverse assemblies forming successive rows, the springs of each assembly being inscribed in a prism with a substantially rectangular base and these prisms, juxtaposed in the longitudinal direction of the mattress, defining by their free, opposite, lateral faces, the two principal surfaces of the mattress, two adjacent assemblies of springs having homologous edges at said principal surfaces and being connected together exclusively at the level of the edges contiguous with the prisms which define them, lying in said principal surfaces, the two adjacent assemblies of springs are disposed with a certain mutual spaced apart relationship and are connected, through the space thus created, by elastically deformable connecting elements, capable of taking up effort both of extension and of compression, which enable the edges opposite the prisms defining these assemblies mutually to move closer to or away from one another, and thus allow a break of the principal surfaces of the mattress by flexion at the level of said space, the connecting elements comprising a group of connecting members each a one piece rod shaped to form two first elastically deformable elements in parallel planes and disposed between the homologous edges of the assemblies of springs respectively lying in the same principal surfaces of the mattress, each rod also forming an elastically deformable element joined to and disposed in an oblique plane between the first elements in the thickness of the body and between the edges non-contiguous with said adjacent assemblies lying respectively in one and in the other of said principal surfaces, the planes of the three joined elements being such as to have the section through a peripheral plane in the form of a Z.

* * * * *

UNITED STATES PATENT AND TRADEMARK OFFICE

CERTIFICATE OF CORRECTION

PATENT NO. : 4,662,011

DATED : May 5, 1987

INVENTOR(S) : Jean-Marie Duvivier

It is certified that error appears in the above-identified patent and that said Letters Patent are hereby corrected as shown below:

The correct filing date of the application is July 15, 1985

The patent claims should be corrected as follows:

Claim 2, line 3, after "elastically" insert -- deformable --
Claim 4, line 1, change "claim 3" to -- claim 1 --
Claim 4, line 4, after "by" insert -- said --
Claim 5, line 1, change "claim 3" to -- claim 1 --
Claim 5, line 1, delete "fastening"
Claim 6, line 2, delete "are constituted by" and insert therefor -- comprise --
Claim 7, line 2, delete "constituted by elastic rods made"

Patent claim 3 should be canceled. Patent claims 4, 5, 6, 7, 8, 9 and 10 should then be renumbered 3 through 9 and dependencies changed accordingly.

Signed and Sealed this

Thirteenth Day of October, 1987

*Attest:*

DONALD J. QUIGG

*Attesting Officer*

*Commissioner of Patents and Trademarks*